US005979055A

United States Patent [19]

Sauer et al.

[11] Patent Number: 5,979,055

[45] Date of Patent: Nov. 9, 1999

[54] PROCESS FOR PRODUCING ROLLFORMED SECTIONS

[75] Inventors: Gale E. Sauer, Sinclairville, N.Y.; Henry G. Stein, Lancaster, Pa.

[73] Assignee: Worthington Armstrong Venture, Malvern, Pa.

[21] Appl. No.: 08/773,270

[22] Filed: Dec. 23, 1996

Related U.S. Application Data

[63] Continuation of application No. 08/375,261, Jan. 19, 1995, abandoned, which is a continuation of application No. 08/168,999, Dec. 20, 1993, abandoned, which is a continuation of application No. 08/002,241, Jan. 8, 1993, abandoned.

[51] Int. Cl.[6] ..... B23P 15/00

[52] U.S. Cl. ..... 29/897.35; 29/897.3

[58] Field of Search ..... 29/21.1, 432.2, 29/897.35, 897.3; 172/186; 52/506.07, 729.5, 730.1, 731.7, 733.1, 733.2, 733.4

[56] References Cited

U.S. PATENT DOCUMENTS

| | | | |
|---|---|---|---|
| 804,799 | 11/1905 | Edison . | |
| 1,649,363 | 11/1927 | Parsons . | |
| 2,254,558 | 9/1941 | Williams . | |
| 2,297,948 | 10/1942 | Eisenhauer | 29/21.1 |
| 2,671,361 | 3/1954 | Sandberg . | |
| 2,688,890 | 2/1954 | Latour . | |
| 2,924,312 | 2/1960 | Williams . | |
| 3,022,687 | 2/1962 | Richards . | |
| 3,129,489 | 4/1964 | Nelson | 29/21.1 |
| 3,284,873 | 11/1966 | Noel | 29/21.1 |
| 3,570,198 | 3/1971 | Ruhnke | 52/733.2 |
| 3,599,318 | 8/1971 | Behlen . | |
| 3,726,000 | 4/1973 | Hafner | 29/21.1 |
| 3,934,327 | 1/1976 | Hafner | 29/432 |
| 4,297,866 | 11/1981 | Sakauye et al. | 72/186 |
| 4,394,794 | 7/1983 | Shirey . | |
| 4,489,529 | 12/1984 | Ollinger et al. | 52/731.7 |
| 4,621,511 | 11/1986 | Knudson | 72/186 |
| 4,679,375 | 7/1987 | Shirey | 52/506.07 |
| 4,730,433 | 3/1988 | Ollinger et al. | 52/733.1 |
| 5,117,602 | 6/1992 | Marschak | 52/731.7 |
| 5,138,758 | 8/1992 | Gubbiotti et al. | 29/432.2 |

FOREIGN PATENT DOCUMENTS

| | | | |
|---|---|---|---|
| 0015580 | 9/1980 | European Pat. Off. . | |
| 0383993 | 6/1989 | European Pat. Off. . | |
| 2 700 366 | 7/1994 | France . | |
| 44 00 185 | 7/1994 | Germany . | |
| 133936 | 7/1985 | Japan . | |
| 0708236 | 4/1954 | United Kingdom . | |
| 0713625 | 8/1954 | United Kingdom . | |
| 0910157 | 11/1962 | United Kingdom . | |
| 0978554 | 12/1964 | United Kingdom . | |
| 1211895 | 11/1970 | United Kingdom . | |
| 1412303 | 11/1975 | United Kingdom . | |
| 2142356 | 1/1985 | United Kingdom | 52/506.07 |
| 2274080 | 3/1994 | United Kingdom . | |
| 2 274 080 | 7/1994 | United Kingdom . | |
| 2274080 | 6/1995 | United Kingdom . | |
| WO 89/07020 | 8/1989 | WIPO . | |
| WO 89/10808 | 11/1989 | WIPO . | |

OTHER PUBLICATIONS

Letter dated Feb. 25,1992 from Sixbey et al. to Clifford B. Price, Esq. 3 pages.

*Primary Examiner*—Irene Cuda

[57] ABSTRACT

A cold forming process includes mechanically joining two strips of metal. The process entails two roll passes. The first pass lances and forms short locking areas through both strips of metal. The second pass compresses and flairs the metal at these areas to complete a mechanical interlock. This method can provide a row of closely spaced fastenings at high speed. It is applicable in improving the torsion strength of existing tee grid products. It is also applicable in creating more efficient rollformed shapes by providing a means to use more than one metal strip.

5 Claims, 3 Drawing Sheets

PROCESS FOR PRODUCING ROLLFORMED SECTIONS

This application is a continuation of application Ser. No. 08/375,261, filed Jan. 19, 1995, now abandoned; which is a continuation of application Ser. No. 08/168,999, filed Dec. 20, 1993, now abandoned; which is a continuation of application Ser. No. 08/002,241 filed Jan. 8, 1993, now abandoned.

BACKGROUND OF THE INVENTION

1. Field of the Invention

This invention relates to ceiling runners for a suspended ceiling system. More specifically it relates to a method of mechanically joining two strips of metal together. The method is well suited to be used within a high speed rollforming process. In addition, it will be disclosed that grid tee sections customarily manufactured through rollforming can be improved and made more efficient by use of this method.

2. Description of the Prior Art

To date many methods have been developed to mechanically fasten two layers of sheet metal together. Most methods require a series of press hits as per U.S. Pat. Nos. 3,083,794, 3,614,819 and 3,726,000. These methods require the material to be stationary and are not suited for close spacing in a fast moving manufacturing process such as rollforming.

U.S. Pat. No. 4,206,578 illustrates an earlier grid tee product with a second strip of metal fastened within the section. The method used in this product lances an ear on three sides and folds it through and around to achieve the mechanical attachment. A through opening is a result of this method. This opening would be unacceptable for product applications where routings and formed locks are to be applied to the section over the fastened areas.

U.S. Pat. No. 4,489,529 discloses a means to improve the rotational stiffness of a grid tee section through the application of a series of vertical lances along the base of the vertical web.

U.S. Pat. Nos. 3,284,873 and 3,726,000 disclose the use of punches to pierce two adjacent pieces of material to fasten the two pieces together. A commercial product of Eastern Products was similar to that of U.S. Pat. No. 3,726,000.

The new process invention can be used to provide a series of attached points along the vertical web, without vertical lances or piercing of metal as shown in the prior art, which will be more effective in improving rotational stiffness.

SUMMARY OF THE INVENTION

The present invention is directed to a process for mechanically joining two strips of metal and improved linear runners achieved through use of the process.

Two adjacent metal strips can be joined by a closely spaced series of fastened points. The fastening points are achieved by passing the strips of metal through two sets of rolls.

The first roll pass is comprised of two cooperating rolls. One roll contains a series of small punches spaced around the roll circumference. Each punch has two parallel cutting edges. The opposite roll has a continuous groove around the roll with the two shoulders of the groove also being cutting edges. The two rolls are positioned to enable the punches to penetrate the groove with the cutting edges in close proximity. When two adjacent strips of metal are passed through the rotating rolls, the small punches will shear and displace portions of the adjacent metal into the groove. The rolls and spacing of the rolls are dimensioned to displace the metal approximately two metal thicknesses.

A second set of rolls must follow the first set of rolls to complete the mechanical bonding. One of the rolls of the second pass has a groove to enable the lanced and formed portions of the strips to pass through. The opposite roll has a series of punches coordinated with the first pass punch roll. These punches will compress the metal adjacent the short lances. The shoulders of the opposite groove roll will act as an anvil for flowing the metal. As the metal flows over the adjacent displaced areas, mechanical bonding is achieved.

This process can be used to achieve improved and more efficient shapes and sections.

One use would be to apply the row of fasteners to the web of a double web inverted tee section. This will provide a stronger tee in resisting rotation.

A second application would be to make a more efficient inverted tee section through fastening a third strip to achieve one flange and omitting unnecessary steel cost in the web.

A third application would be to make a more efficient box face grid section. A lighter gauge painted and finished exposed box portion could be fastened to a simple tee runner.

BRIEF DESCRIPTION OF THE DRAWINGS

FIG. 1 shows a side view of the first roll tooling with material going through.

FIG. 4 shows a side view of the second roll tooling with material going through.

DESCRIPTION OF THE PREFERRED EMBODIMENTS

Figure 5:
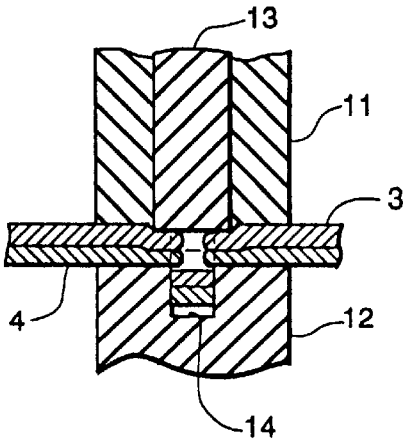
FIG. 5 shows a section along line V—V of FIG. 4 of the tooling processing the metal.
Figure 6:
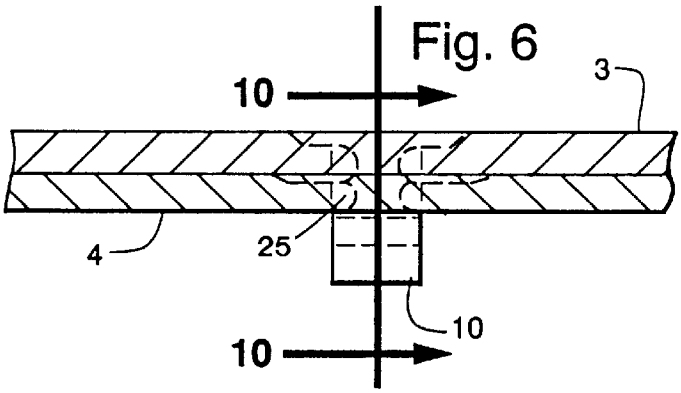
FIG. 6 shows an end view of the strips mechanically bonded.
Figure 7:
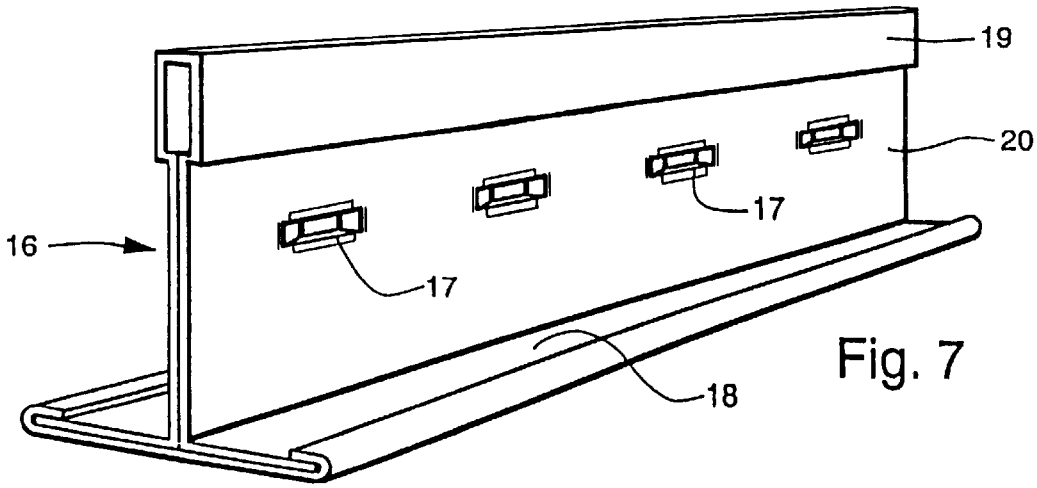
FIG. 7 shows a structurally improved web section of a runner which uses the process of this invention.
Figure 8:
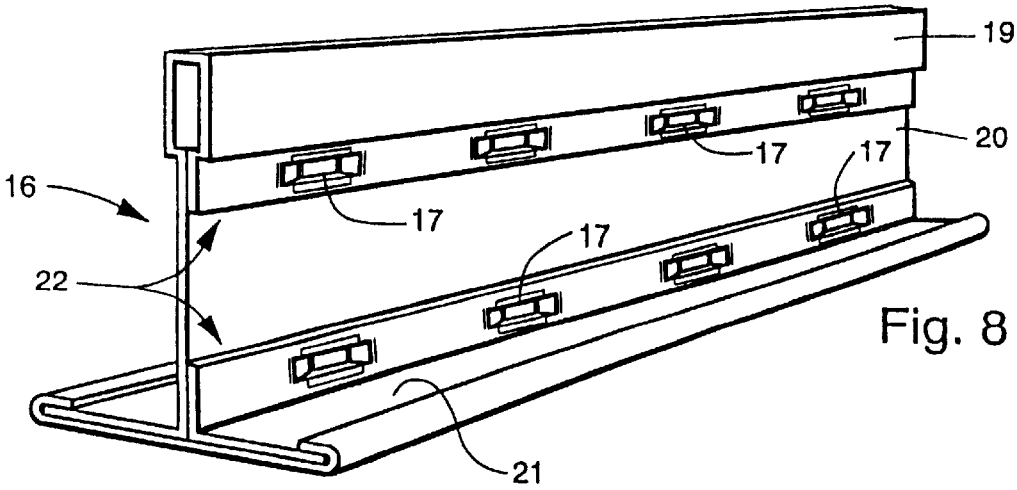
FIG. 8 shows a cost reduced, more efficient section which uses the process of this invention.
Figure 9:
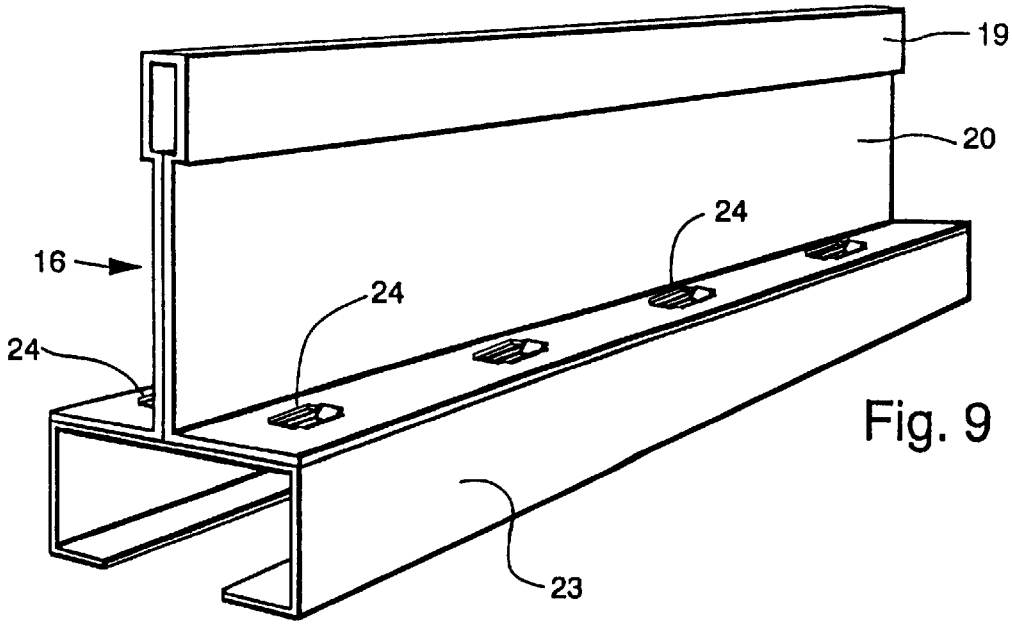
FIG. 9 shows a more efficient box tee runner section which uses the process of this invention.

FIGS. 1–6 and 10 illustrate a process for mechanically joining two strips of metal. FIGS. 7–9 illustrate support runners which used this process to enable them to perform their functions more efficiently.

Figure 1:
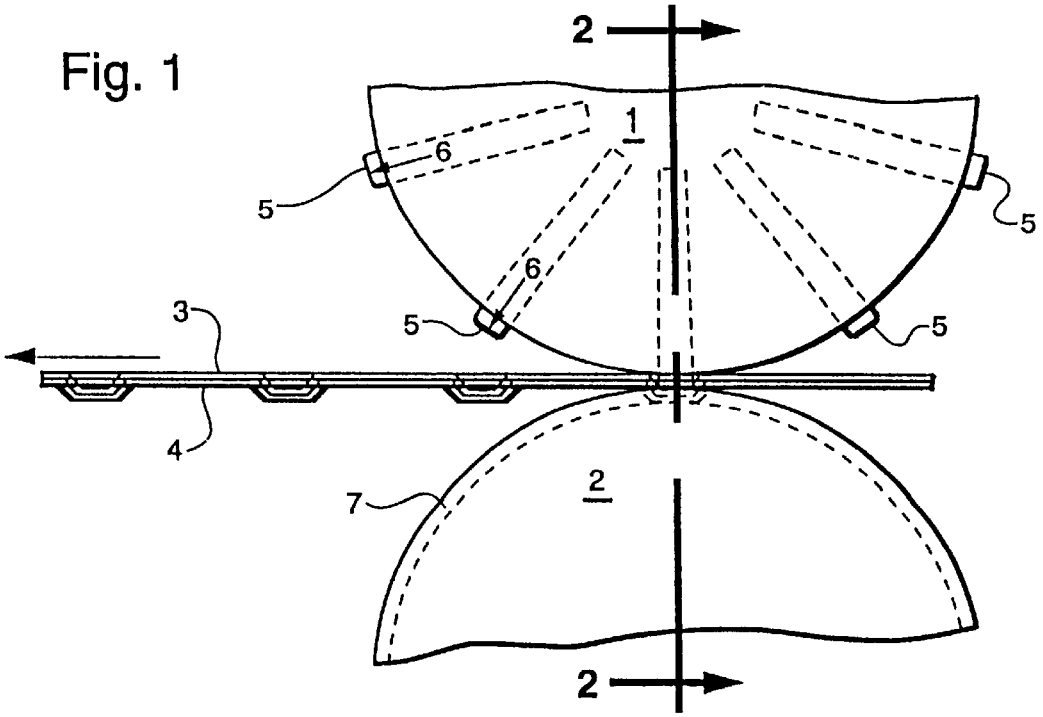
Figure 2:
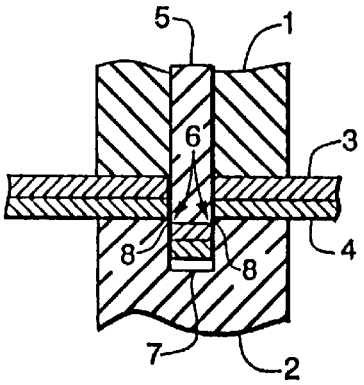
FIG. 2 shows a section along line II—II of FIG. 1 of roll tooling with material being processed.

The process for mechanically joining two strips of metal entails two roll passes. Each roll pass consists of two cooperating rolls between which the strips of metal to be joined are drawn. FIG. 1 shows the first pass consisting of roll 1 and roll 2. Two strips of metal 3 and 4 pass between. Roll 1 contains a series of punches 5 mounted about its circumference and extending slightly beyond the roll surface. Each rectangular punch has two cutting edges 6, FIG. 2, parallel to each other and parallel to the movement of the metal strips.

In pass number one, roll 1 is positioned adjacent roll 2. Roll 2 has a continuous groove 7 about its circumference which is slightly larger than the width of the punches 5 of roll 1. The outer shoulders 8 of the groove are cutting edges. As the metal strips 3 and 4 pass through the first pass rolls 1 and 2, the punches 5 will engage the strip pushing metal into the groove 7 of roll 2. As the metal is pushed into the groove 7, it is lanced on two parallel sides, parallel to metal movement, due to shear action between the cutting edges of the punches 6 and the cutting shoulders 8 to provide two parallel slits.

Figure 3:
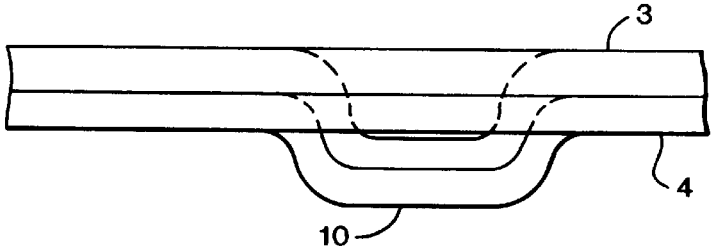
FIG. 3 shows a side view of metal strips after the first roll pass.

The rolls and punches of pass number one are spaced and dimensioned to displace the metal near equal to the combined thicknesses of the strips to be bonded. FIG. 3 shows a lanced and formed metal configuration 10 as applied to the strips in pass number one.

Figure 4:
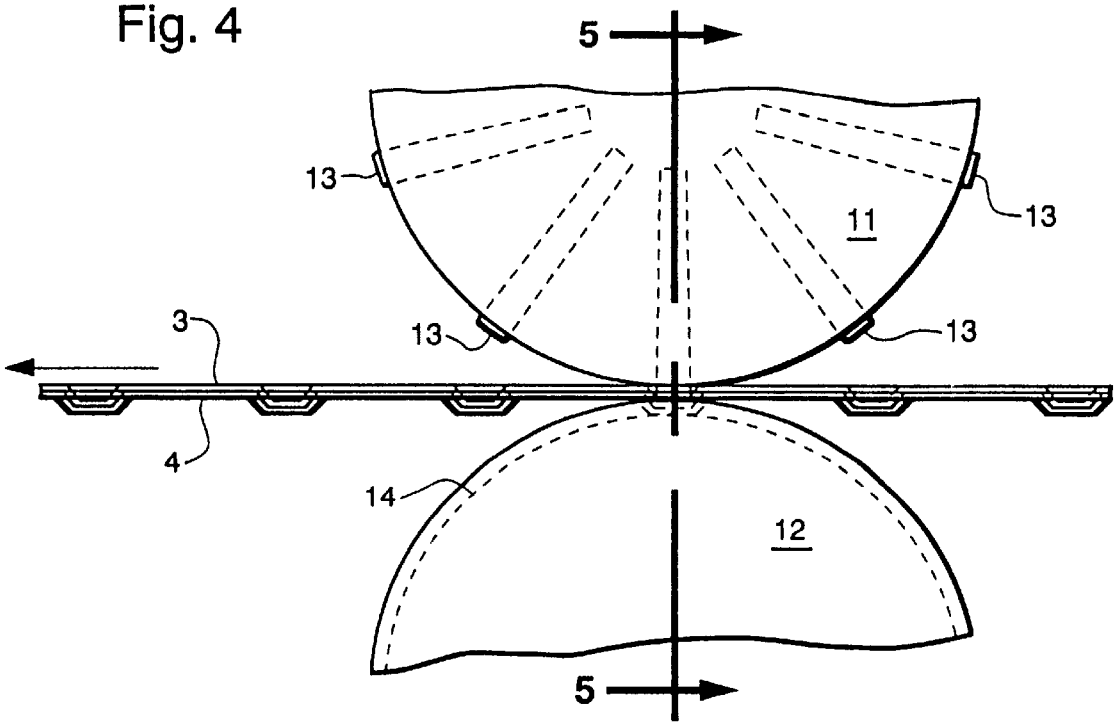

As the metal strips to be mechanically bonded leave roll pass number one, they enter roll pass number two. FIG. 4 illustrates pass number two.

Figure 10:
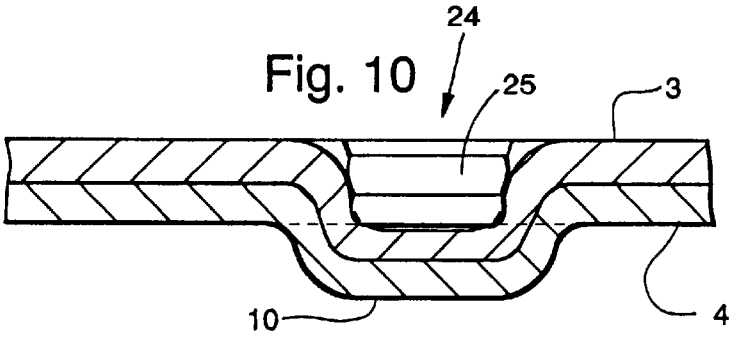
FIG. 10 is an enlarged view of the fastener 24 of FIG. 9.

One roll 11 of pass number two is a punch roll. This punch roll 11 is coordinated with the first pass punch roll 1 so that the punches 13 will strike the areas on the strip adjacent those lanced and formed in pass number one. The punches 13 of pass number two are larger in dimension so that they will strike the metal adjacent the lances and displace these areas. Opposing the punch roll 11, roll 12 has a groove 14 which allows the metal portions displaced in pass number one to pass through (FIG. 5). As the metal strips pass through roll pass number two, the rectangular punches 13 compress the metal against roll 12 adjacent the groove 14. As this is done, metal cold flows laterally overlapping the lanced and formed area to complete a mechanical interlock. This compressing and metal flow 25 is illustrated in FIGS. 6 and 10. The completed interlocked fastener is illustrated in FIGS. 5 and 6. As shown in FIG. 4, the punch 13 is the width of the displaced metal. FIGS. 7, 8 and 9 show the same feature wherein the metal that has cold flowed is displaced along the rectangular width of the displaced metal. The area of cold flow is particularly clear in the showing of the fasteners 24 of FIGS. 9 and 10. Particularly, the lead and trail corners of the lanced and displaced metal, at the ends of the parallel slits, is held in place by the metal that has cold flowed along the parallel slits.

A consecutive line of closely spaced fasteners can be applied to metal strips as described above. This process is especially suited for use in conjunction with rollforming.

FIG. 7 shows a ceiling runner 16 with a line of fasteners 17 applied to it as per this invention. With the line of fasteners occurring any place between the flange 18 and the bulb 19, the web section 20 is significantly strengthened to resist torsional forces.

FIG. 8 shows a substitute rollformed shape made by the fastening process of this invention. One flange is formed from another strip 21. Metal is removed from the web area 22 where it has little structural value and thereby provides a more economical product.

FIG. 9 shows an inverted box tee runner using the fastening process of this invention. The box portion 23 of the section is formed from a second strip of metal separate from the runner 16. The fasteners 24 on either side of the web 20 hold the flanges of the runner 16 to the box portion 23. This permits the strip of the box section to be of thinner steel than the runner. Further, the cost of finish painting both sides of the runner can be omitted.

The alternate web structures of FIGS. 7–9 can have the parts fastened by the fastening process herein or an alternate fastening process such as that of U.S. Pat. No. 3,726,000. The preferred fastening process is that disclosed herein and the alternate process is not the equivalent of the disclosed process.

What is claimed is:

1. In a method that combines (a) making a grid beam, including making a web of two adjacent layers in the beam, from metal strip, by continuously passing the metal strip through successive sets of rolls that act on the strip, with (b) strengthening the grid beam, as the beam is being made, by (1) lancing two parallel slits into the two layers of the web longitudinally of the beam and displacing the two layers of the web between the slits to form a depression that is open in a first surface of the web, as the web passes through one set of rolls;

the improvement comprising;

(2) interlocking the two displaced layers of the web by striking the first surface of the web along and outside the depression to compress and cold flow metal into the depression, as the depression passes through another set of rolls.

2. A method according to claim 1, wherein the step of interlocking the two displaced layers of the web by striking further comprises striking with a punch while the punch and the web move together longitudinally of the beam.

3. A method according to claim 1, wherein the step of interlocking further comprises coordinating the one set of rolls with the another set of rolls, so that the striking occurs along and outside the opening.

4. A method according to claim 2, wherein the step of interlocking further comprises coordinating the one set of rolls with the another set of rolls, so that the striking occurs along and outside the opening.

5. A method according to any one of the preceding claims, the improvement further comprising the step of repeating steps (1) and (2).

* * * * *